US005503954A

United States Patent [19]

Maruta et al.

[11] Patent Number: 5,503,954

[45] Date of Patent: Apr. 2, 1996

[54] NONMAGNETIC ONE-COMPONENT TONER AND METHOD FOR PRODUCING THE SAME

[75] Inventors: Masayuki Maruta, Hannan; Shin-ichi Sata, Wakayama; Yasuhiro Hidaka, Kainan, all of Japan

[73] Assignee: Kao Corporation, Tokyo, Japan

[21] Appl. No.: 238,046

[22] Filed: May 4, 1994

[30] Foreign Application Priority Data

May 19, 1993 [JP] Japan ..... 5-116742

[51] Int. Cl.[6] ..... G03G 9/087

[52] U.S. Cl. ..... 430/110; 430/111; 430/903

[58] Field of Search ..... 430/110, 111, 430/903

[56] References Cited

U.S. PATENT DOCUMENTS

| | | | |
|---|---|---|---|
| 2,895,847 | 7/1959 | Mayo . | |
| 3,152,012 | 10/1964 | Schaffert . | |
| 3,909,258 | 9/1975 | Kotz | 430/122 |
| 4,121,931 | 10/1978 | Nelson | 118/657 |
| 5,143,809 | 9/1992 | Kaneko et al. | 430/105 |
| 5,296,324 | 3/1994 | Akagi et al. | 430/111 X |
| 5,437,954 | 8/1995 | Saito | 430/111 X |

FOREIGN PATENT DOCUMENTS

| | | |
|---|---|---|
| 0460665 | 12/1991 | European Pat. Off. . |
| 0523654 | 1/1993 | European Pat. Off. . |
| 3809217 | 9/1988 | Germany . |

OTHER PUBLICATIONS

Patent Abstracts of Japan, vol. 9, No. 276 (P–402) (1999) Nov. 2, 1985 and JP–A–60 121 454 (Kao Corporation) p. 8, lines 40–45, claims 1, 7–9, p. 9, line 49–p. 17, line 5, Dec. 11, 1991.

Database WPI, Abstract, Week 9049, Derwent Publications Ltd., London, GB; AN 90–364450 and JP–A–2 261 536 (Kurimoto Iron Works) Oct. 24, 1990.

English language abstract of JP–A–59–231549.

English language abstract of JP–A–63–226666.

English language abstract of JP–A–64–77075.

English abstract of JP–A–3–294864.

English abstract of JP–A–63–279261.

*Primary Examiner*—Roland Martin

*Attorney, Agent, or Firm*—Birch, Stewart, Kolasch & Birch

[57] ABSTRACT

A nonmagnetic one-component toner is produced by the steps of applying inorganic fine particles having an average particle diameter of not less than 30 nm and less than 100 nm to the surface of the toner having a binder resin and a colorant; and removing agglomerations of the inorganic fine particles remaining unadhered on the toner surface using a cyclone in a gas stream. The inorganic fine particles used in the present invention have a particle diameter in suitable ranges, so that the resulting toner can have suitable powder fluidity, and that these inorganic fine particles are less likely to be embedded into the inner portion of the toner by the nip pressure exerted by such members as the charging blade. Therefore, by using the toner of the present invention, a nonmagnetic one-component developing system with small variations in image density and image quality after continuous copying can be provided.

6 Claims, No Drawings

NONMAGNETIC ONE-COMPONENT TONER AND METHOD FOR PRODUCING THE SAME

BACKGROUND OF THE INVENTION

1. Field of the Invention

The present invention relates to a powdery toner used for visualizing a latent image formed on a photoconductor in electrophotography, electrostatic recording, etc., and a method for producing such a toner. More particularly, it relates to a toner suitable for a nonmagnetic one-component developing method which can be conveniently used for compact printers, plain paper facsimiles, etc., and a method for producing such a toner.

2. Discussion of the Related Art

In conventional methods in electrophotography, electrostatic recordings, etc., as the most convenient method for visualizing the latent image formed on the photoconductor using a powdery toner, there have been proposed two-component magnetic brush developing methods using a developer consisting of two components, namely, a toner and a carrier, the carrier being used for the purposes of supplying electric charges to the toner and of conveying the charged toner onto the latent image portion by a magnetic force.

However, in the two-component magnetic brush developing method, since a magnetic force is utilized in the conveying of the developer, a magnet has to be placed in the developer roller, and the carrier is made of a metal or an oxide thereof such as iron powder, nickel powder, and ferrite. Therefore, the developer device and the developer become undesirably heavy, thereby making it difficult to miniaturize and thus reduce the weight of the overall recording device.

On the other hand, as disclosed in U.S. Pat. Nos. 3,909,258 and 4,121,931, there have been conventionally well used magnetic one-component developing methods comprising the step of conveying a toner to the latent image portion without using a carrier, the methods being carried out by utilizing a magnetic force owned by the toner containing a magnetic substance therein. However, a magnet has to be also used in the inner portion of the developer roll in this developing method, making it difficult to reduce the weight of the developer device.

In order to solve the problems in these developing methods, much investigations have been recently conducted on nonmagnetic one-component developing methods wherein a toner alone is used without containing any magnetic powder, as disclosed, for instance, in U.S. Pat. Nos. 2,895,847 and 3,152,012, and Japanese Patent Examined Publication Nos. 41-9475, 45-2877 and 54-3624.

However, in the conventional nonmagnetic one-component developing methods, since toners are provided with electric charges only at an instant when the toner passes near the charging blade, the charging control of the toner in these methods is extremely difficult. In order to solve this problem, there have been proposed a method in which a silica fine powder surface-treated with a titanate coupling agent, the silica fine powder having a particle diameter of 1 to 2000 nm, is added to the surface of the toner containing a styrene-butadiene copolymer as a binder resin (see, for instance, Japanese Patent Laid-Open No. 59-231549); and a method in which a particular charge control agent is used (see, for instance, Japanese Patent Laid-Open No. 63-226666).

On the other hand, it is also important to improve the contact efficiency of the toner with the charging blade. In order to achieve good contact efficiency, various external additives have been investigated, as disclosed, for instance, in Japanese Patent Laid-Open Nos. 64-77075, 3-294864, etc. Further, for the purpose of solving the problem of poor charging of small toners passing besides large toners, a particle diameter distribution has been also investigated as disclosed, for instance, in Japanese Patent Laid-Open No. 63-279261.

However, in the above methods, although toners may provide good fixed images at start, during repeated copying and supplying of the toner, such problems arises that the image density lowers, that the background increases and that the resolution of formed image lowers.

In the meantime, Japanese patent Laid-Open No. 3-294864 discloses that inorganic fine particles having a particle diameter of 0.1 to 1.0 μm are added to the toners. However, the inorganic fine particles in this reference are added for the purpose of polishing the surface of photoconductor to remove toner filmings formed on the photoconductor.

SUMMARY OF THE INVENTION

An object of the present invention is to provide a toner excellent in developability and stability with the passage of time in the developing method using the nonmagnetic one-component toner, so as to stably form high-quality copying images having an appropriate image density free from background.

Another object of the present invention is to provide a method for producing such a toner.

In order to solve the above problems, the present inventors have analyzed conventional nonmagnetic one-component toner and found that a spent toner has a poor powder fluidity when compared with a toner before use. This can be clearly confirmed by observing the surface of the spent toner using a scanning electron microscope. As a result, inorganic fine particles which are observed on the surface of the toner before use are no longer present on the surface of the spent toner. The present inventors have further conducted an inorganic elemental analysis on the toner surface. As a result, they have found that the spent toner contains substantially the same amount of inorganic oxides as the toner before use. The present inventors have found from the above results that the deterioration of image quality due to repeated copying may be caused by the gradual embedding of the inorganic fine particles on the toner surface into an inner portion of the toner by a frictional force with such members as a charging blade, and thus making the fluidity of the toner poor. As a result of intense research based on the above findings, the present inventors have found that the above-mentioned problems can be solved by adhering the inorganic fine particles having a particular range of particle diameter to the surface of the toner. The present invention is based on the above findings.

The present invention is concerned with a nonmagnetic one-component toner comprising a non-additive toner containing a binder resin and a colorant, and inorganic fine particles having an average particle diameter of not less than 30 nm and less than 100 nm, the inorganic fine particles being adhered to the surface of the non-additive toner, and also concerned with a method for producing such a toner.

The nonmagnetic one-component toner of the present invention is suitably used for a developer device having a developer roller and a blade, the blade serving to regulate a toner layer formed on the developer roller into a uniform thickness and to supply electric charges to the toner.

The inorganic fine particles used in the present invention have a particle diameter in suitable ranges, so that the resulting toner can have suitable powder fluidity, and that these inorganic fine particles are less likely to be embedded into the inner portion of the toner by the nip pressure exerted by such members as the charging blade. Therefore, by using the toner of the present invention, a nonmagnetic one-component developing system with small variations in image density and image quality after continuous copying can be provided.

Moreover, the effects of the present invention become even more outstanding when using as a binder resin, a polyester resin which is not easily deformed by the nip pressure exerted by such members as a charging blade, and has a glass transition temperature of not less than 70° C., the polyester resin, in particular, being polymerized between such monomer components as a bisphenol A monomer and an alkenyl succinic acid monomer.

DETAILED DESCRIPTION OF THE INVENTION

In the present invention, the average particle diameter of the inorganic fine particles is normally not less than 30 nm and less than 100 nm, preferably not less than 30 nm and not more than 70 nm. When the average particle diameter of the inorganic fine particles is less than 30 nm, the inorganic fine particles are likely to be embedded in the surface of the non-additive toner, thereby making the stability of the images with the passage of time obtained by the nonmagnetic one-component toner unsatisfactory. On the other hand, when the inorganic fine particles having an average particle diameter of not less than 100 nm are adhered to the surface of the non-additive toner, the resulting toner does not have a good fluidity, so that image density and image quality of 10 the toner do not satisfactorily meet the requirement. The inorganic fine particles having such a particle diameter of not less than 100 nm are likely to be detached from the toner surface, so that the photoconductor or the charging blade in the developer device is likely to be damaged. Here, non-additive toner refers to a toner which contains binder resins, colorants, and other additives before the surface treatment with the inorganic fine particles.

The particle diameter of the inorganic fine particles used in the present invention can be measured by a particle diameter distribution measuring device utilizing dynamic light scattering. However, since the dissociation of the agglomerated particles would be difficult, the best method for obtaining the particle diameter is to analyze the particle diameter from an electrophotograph taken by a scanning electron microscope. When expressed by another parameter, the particle diameter of the inorganic fine particles with a BET specific surface area of 20 to 80 $m^2/g$ corresponds to the particle diameter mentioned above.

Examples of the components for the inorganic fine particles used in the present invention include any of conventionally known ones such as silica, alumina, titania and zirconia with a preference given to silica, alumina and titania. Also, the inorganic fine particles of which the surface is subject to hydrophobic treatment with a silane coupling agent, silicone oils, etc. are preferred from the viewpoint of environmental stability in the tribo electric charge of the toner. In the present invention, the hydrophobicity may be evaluated by methanol hydrophobicity.

The amount of the inorganic fine particles added to the toner surface is preferably 0.1 to 5% by weight, more preferably 0.1 to 2% by weight, based on the non-additive toner containing binder resins, colorants, and other additives. The amount of the above inorganic fine particles has to be carefully adjusted by considering the particle diameter of the inorganic fine particles and also considering the charging blade material, the nip pressure of the blade and a developer roller material, etc.

The blending proportions of the binder resin, the colorant and the charge control agent contained in the non-additive toner for the toner of the present invention are preferably 75 to 99% by weight of the binder resin, 0.5 to 20% by weight of the colorant, and 0 to 5% by weight, preferably 0.1 to 3% by weight, of the charge control agent.

In the present invention, as methods for adhering inorganic fine particles onto the surface of the non-additive toner, any one of conventionally known methods of blending powder materials can be used. For instance, blending of the non-additive toner with the inorganic fine particles may be carried out using, for instance, Henschel mixer, Super mixer, V-blender, etc.

Also, in the present invention, a toner even more excellent in stability with the passage of time can be obtained by adhering the ! inorganic fine particles onto the surface of the non-additive toner and then removing agglomerations of the inorganic fine particles from the toner surface in a gas stream using a cyclone, etc. Here, the "agglomerations of the inorganic fine particles" refers to agglomeration of free inorganic fine particles which remain unadhered on the toner surface after the inorganic fine particles are applied to the surface of the non-additive toner. Since the agglomeration of the inorganic fine particles easily change its form, it would be difficult to remove them by merely using a vibrating sieve, which is conventionally used for removing foreign materials in toners. Therefore, a separating-and-removing method using such devices as a cyclone in a gas stream has to be used.

As for the components of the toner used in the present invention, conventionally known materials can be used.

Typical examples of monomers for the binder resins used in the present invention include styrene and styrene derivatives such as styrene, chlorostyrene, and α-methylstyrene; ethylenic unsaturated monoolefins such as ethylene, propylene, butylene and isobutylene; vinyl esters such as vinyl acetate, vinyl propionate, vinyl benzoate, and vinyl butyrate; esters of α-methylene aliphatic monocarboxylic acids such as methyl acrylate, ethyl acrylate, butyl acrylate, octyl acrylate, dodecyl acrylate, phenyl acrylate, methyl methacrylate, ethyl methacrylate, butyl methacrylate and dodecyl methacrylate; vinyl ethers such as vinyl methyl ether, vinyl ethyl ether and vinyl butyl ether; vinyl ketones such as vinyl methyl ketone, vinyl hexyl ketone and vinyl isopropenyl ketone. These monomers may be used for homopolymerization, or copolymerization of two Or more monomers in combination, to give the binder resins of the present invention.

Besides them, natural and synthetic waxes, polyester resins, polyamide resins, epoxy resins, polycarbonate resins, polyurethane resins, silicone resins, fluorine-based resins, and petroleum resins can be used, with a preference given to the polyester resins.

From the viewpoint of toughness against stress exerted by such members is a charging blade, the effects of the present invention become outstanding when the polyester having a glass transition temperature of not less than 70° C. is used.

The glass transition temperature of the resin is determined by the method according to conventional methods using DSC.

Here, the "glass transition temperature" used herein refers to the temperature of an intersection of the extension of the baseline of not more than the glass transition temperature and the tangential line showing the maximum inclination between the kickoff of the peak and the top thereof as determined using a differential scanning calorimeter ("DSC Model 200," manufactured by Seiko Instruments, Inc.), at a temperature rise rate of 10° C./min.

The components of the polyester resins suitably used as binder resins in the present invention are detailed below.

Examples of the alcohol components used in the present invention include bisphenol A-based monomers such as polyoxypropylene(2.2)-2,2-bis(4-hydroxyphenyl)propane, polyoxyethylene(2)-2,2-bis(4-hydroxyphenyl)propane, polyoxypropylene(6)-2,2-bis(4-hydroxyphenyl)propane and polyoxypropylene(16)-2,2-bis(4-hydroxyphenyl)propane; and other monomers such as ethylene glycol, propylene glycol, glycerol, pentaerythritol, trimethylolpropane, hydrogenated bisphenol A and sorbitol, and the etherified polyhydroxyl compounds thereof such as polyoxyethylene(10)sorbitol, polyoxyethylene(3)glycerol and polyoxyethylene(4)pentaerythritol.

In the present invention, these alcohol component monomers may be used singly or in combination.

As for the acid components used in the present invention, examples thereof include succinic acid derivatives such as n-dodecenyl succinic acid, isododecyl succinic acid, n-octyl succinic acid, isooctyl succinic acid and n-butyl succinic acid; and other acid components conventionally used for the production of polyester resins such as phthalic acid, isophthalic acid, terephthalic acid, fumaric acid, maleic acid, trimellitic acid and pyromellitic acid, and acid anhydrides thereof, lower alkyl esters thereof and other dicarboxylic acid components.

In the present invention, these acid component monomers may be used singly or in combination.

Particularly, the even more outstanding effects can be achieved, though not intending to restrict the polyester resin in the present invention thereto, when a polyester resin is obtained by condensation polymerization between:

(a) a diol component represented by the following general formula (I):

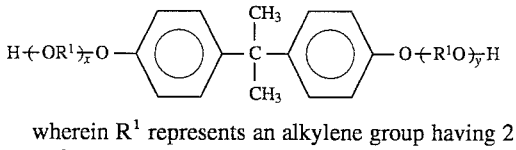

(I)

wherein $R^1$ represents an alkylene group having 2 to 4 carbon atoms, and x and y independently represent positive integers with an average sum of 2 to 16; and (b) an acid component containing:

(i) 1 to 50 mol % of a dicarboxylic acid represented by general formulas (II) or (III):

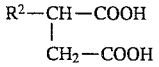

(II)

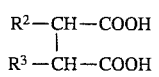

(III)

wherein $R^2$ and $R^3$, which may be identical or different, independently represent a saturated or unsaturated hydrocarbon group having 4 to 20 carbon atoms, or an anhydride thereof; and (ii) 10 to 30 mol % of trimellitic acid or an anhydride thereof.

Here, a preference is given to the case where the dicarboxylic acid of (i) above is alkenyl succinic acid.

The polyester resin used in the present invention can be produced by carrying out a condensation polymerization between a polyol component and a polycarboxylic acid component at a temperature of 180° to 250° C. in an inert gas atmosphere. In order to accelerate this condensation polymerization, conventionally used catalysts for esterification such as zinc oxide, stannous oxide, dibutyltin oxide, and dibutyltin dilaurate can be used.

Examples of the colorants used in the present invention include carbon black; acetoacetic arylamide-based monoazo yellow pigments such as C.I. Pigment Yellow 1, C.I. Pigment Yellow 3, C.I. Pigment Yellow 74, C.I. Pigment Yellow 97 and C.I. Pigment Yellow 98; acetoacetic arylamide-based bisazo yellow pigments such as C.I. Pigment Yellow 12, C.I. Pigment Yellow 13, C.I. Pigment Yellow 14 and C.I Pigment Yellow 17; yellow dyes such as C.I. Solvent Yellow 19, C.I. Solvent Yellow 77, C.I. Solvent Yellow 79, and C.I. Disperse Yellow 164; red or crimson pigments such as C.I. Pigment Red 48, C.I. Pigment Red 49:1, C.I. Pigment Red 53:1, C.I. Pigment Red 57, C.I. Pigment Red 57:1, C.I. Pigment Red 81, C.I. Pigment Red 122, and C.I. Pigment Red 5; red dyes such as C.I. Solvent Red 49, C.I. Solvent Red52, C.I Solvent Red 58 and C.I. Solvent Red 8; blue pigment and dyes of copper phthalocyanine and derivatives thereof such as C.I. Pigment Blue 15:3; green pigments such as C.I. Pigment Green 7 and C.I. Pigment Green 36 (Phthalocyanine Green). These pigments or dyes may be used alone or in combination.

The charge control agents used in the present invention include negative charge control agents and positive charge control agents. Examples of the negative charge control agents include chromium complexes of azo dyes; iron complexes of azo dyes; cobalt complexes of azo dyes; chromium, zinc, aluminum or boron complexes of salicylic acid or derivatives thereof, or complex salt compounds thereof; chromium, zinc, aluminum or boron complexes of 1-hydroxy-2-naphtholic acid or derivatives thereof, or complex salt compounds thereof; chromium, zinc, aluminum or boron complexes of benzylic acid or derivatives thereof, or complex salt compound thereof; surfactants such as long-chain-alkylcarboxylates and long-chain-alkylsulfonates.

Examples of the positive charge control agents include nigrosine dyes and derivatives thereof; triphenylmethane derivatives; derivatives of such salts as quaternary ammonium salts, quaternary phosphonium salts, quaternary pyridinium salts, guanidine salts and amidine salts.

In the toner of the present invention, the following additives may be added, if necessary. The additives include magnetic materials such as ferrite, etc.; conductivity adjusting agents; metal oxides such as tin oxide, silica, alumina, zirconia, titania and zinc oxide; reinforcing fillers such as extenders and fibrous materials; antioxidants; and parting agents.

Further, for the purposes of inhibiting the formation of thin filming of toners on a photoconductor, or improving cleanability of the residual toner on the photoconductor, other additives may be also added in addition to the inorganic fine particles having a particular particle diameter defined in the present invention. Examples of these additives include inorganic oxides such as silica, alumina, titania, zirconia, tin oxide and zinc oxide; fine particles of the resin obtained by homopolymerization or copolymerization using monomers such as acrylic acid esters, methacrylic acid esters and styrene; fluorine-based resin fine particles; silicone resin fine particles; higher fatty acids such as stearic acid, and metal salts thereof; carbon black; lead fluoride; silicon carbide and boron nitride. The particle diameter of these particles do not have to be in the ranges as defined in the present invention.

As the production methods for the toner of the present invention, any one of conventionally known production methods such as a kneading-and-pulverizing method, a spray-drying method, and a polymerization method can be used.

The toner of the present invention described above is suitably used for a developer device having a developer roller and a blade, the blade serving to regulate the toner layer formed on the developer roller into a uniform thickness and to supply electric charges to the toner.

EXAMPLES

The present invention is hereinafter described in more detail by means of the following production example, working examples, comparative examples and test example, but the present invention is not restricted to these examples.

Production Example 1

540 g of polyoxypropylene(2.2)-2,2-bis(4-hydroxyphenyl)propane, 215 g of polyoxyethylene(2)-2,2-bis(4-hydroxyphenyl)propane, 225 g of terephthalic acid, and 31.5 g of n-dodecenyl succinic anhydride are placed in a one-liter four-neck glass flask equipped with a thermometer, a stainless steel stirring rod, a reflux condenser and a nitrogen inlet tube. The contents are heated so as to raise the temperature to 230° C. in a mantle heater to react the components in a nitrogen gas atmosphere while stirring the contents. The acid value as measured at a point where no more water is produced by the reaction is 1.5 mg KOH/g.

Further, 94.0 g of trimellitic anhydride is added to the above mixture to react the components for about 8 hours. The reaction is terminated when the softening point measured by the ring ball method reaches 130° C. The resulting resin is a pale yellow solid having an acid value of 25 mg KOH/g, a hydroxyl value of 26 mg KOH/g, a glass transition temperature of 74° C., and a weight-average molecular weight of 180,000.

EXAMPLE 1

| | |
|---|---|
| Resin Obtained in Production Example 1 | 100 parts by weight |
| Carbon Black | 4 parts by weight |
| Chromium Complexes of Azo Dyes | 1.5 parts by weight |
| Low-Molecular Weight Polypropylene Wax | 2 parts by weight |

The above components are mixed in advance and then kneaded using a pressure kneader, and the kneaded mixture is pulverized and classified to give a non-additive toner having a weight-average particle size of 10 μm. 100 parts by weight of the above non-additive toner is blended with 0.8 parts by weight of a silica "R-809" (manufactured by Nippon Aerosil Ltd.) having an average particle diameter of 40 nm using a Henschel mixer to give a toner according to the present invention. Here, the average particle diameter is measured by SEM photo.

EXAMPLE 2

A silica "MOX-80" (manufactured by Nippon Aerosil Ltd.) having an average particle diameter of 30 nm which is measured in the same manner as in Example 1 is treated with hexamethyldisilazane to give a hydrophobic silica "A" having a methanol hydrophobicity of 38%.

100 parts by weight of the non-additive toner prepared in the same manner as in Example 1 is blended with 0.6 parts by weight of the hydrophobic silica "A" to give a toner according to the present invention.

EXAMPLE 3

An alumina (manufactured by Taimei Kagaku Co.) having an average particle diameter of 60 nm which is measured in the same manner as in Example 1 is treated with hexamethyldisilazane to give a hydrophobic alumina "B" having a methanol hydrophobicity of 21%.

100 parts by weight of the non-additive toner prepared in the same manner as in Example 1 is blended with 1.2 parts by weight of the hydrophobic alumina "B" to give a toner according to the present invention.

Comparative Example 1

100 parts by weight of the non-additive toner prepared in the same manner as in Example 1 is blended with 0.3 parts by weight of a hydrophobic silica "Aerosil R-972" (manufactured by Nippon Aerosil Ltd.) having an average particle diameter of 16 nm which is measured in the same manner as in Example 1 to give a comparative toner.

Comparative Example 2

An alumina (manufactured by Taimei Kagaku Co.) having an average particle diameter of 120 nm which is measured in the same manner as in Example 1 is treated with hexamethyldisilazane to give a hydrophobic alumina "C" having a methanol hydrophobicity of 38%.

100 parts by weight of the non-additive toner prepared in the same manner as in Example 1 is blended with 2.0 parts by weight of the hydrophobic alumina "C" to give a comparative toner.

Test Example

Continuous printing tests are conducted using a modified apparatus of a plain paper facsimile "TF-58HW" (manufactured by Toshiba Corporation) for the toners obtained in Examples 1 to 3 and Comparative Examples 1 and 2. The printing image quality is evaluated by measuring image density and percentage of background on a photoconductor, and observing defects of the formed images. Also, the aerated bulk density of the toner before and after the tests is measured. The results are shown together in Table 1.

Here, the image density is evaluated by using a Macbeth densitometer. The percentage of background on photoconductor is obtained by taking out the images formed on the photoconductor using a mending tape, measuring an Y-value using a color and color difference meter "CR-221" (manufactured by Minolta Camera Co., Ltd.), and calculating the percentage from the Y-values of the mending tapes before and after testing. Also, the aerated bulk density of the toner is measured using "Powder-Tester PT-E (manufactured by Hosokawa Micron Co.)".

TABLE 1

| Type of Toner | Example No. 1 | Example No. 2 | Example No. 3 | Comparative Example No. 1 | Comparative Example No. 2 |
|---|---|---|---|---|---|
| At Start | | | | | |
| Aerated Bulk Density (g/cc) | 0.340 | 0.337 | 0.342 | 0.334 | 0.344 |
| Average Particle Diameter (μm) | 10.0 | 10.0 | 10.0 | 10.0 | 10.0 |
| Image Density | 1.37 | 1.36 | 1.38 | 1.37 | 1.38 |
| Background on Photoconductor (%) | −1.2 | −0.9 | −1.7 | −0.6 | −2.0 |
| After Copying 2000 Sheets | | | | | |
| Aerated Bulk Density (g/cc) | 0.354 | 0.348 | 0.357 | 0.286 | 0.360 |
| Average Particle Diameter (μm) | 11.0 | 11.2 | 10.9 | 11.4 | 10.8 |
| Image Density | 1.36 | 1.37 | 1.36 | 1.18 | 1.37 |
| Background on Photoconductor (%) | −1.8 | −1.2 | −1.9 | −2.5 | −2.5 |
| Defects of Formed Images | None | None | None | Lack of Uniformness in the Image-Forming Portion | Generation of Black Spots |

As is shown in Table 1, in the case of toners according to the present invention, the aerated bulk density of the toner is not reduced after continuous printing test for 2,000 sheets, thereby stably providing excellent image quality. On the other hand, in the case of using the toner in Comparative Example 1 where a silica having a smaller particle diameter is added, the aerated bulk density of the toner is reduced, the image density is also reduced, and lack of uniformness is observed in the image-forming portion of the formed images. In the case of the toner in Comparative Example 2 where inorganic particles having a larger particle diameter are added, the photoconductor is damaged, and the accumulation of inorganic particles on the damaged portions is observed. The surfaces of the toner in Example 1 and the toner in Comparative Example 1 after conducting continuous printing tests for 2,000 sheets are observed by a scanning electron microscope. As a result, it has been found that the silica remains on the toner surface in Example 1, whereas substantially no silicas are observed on the toner surface in Comparative Example 1.

EXAMPLE 4

The toner obtained in Example 1 is further classified by a modified device of an MDS classifier (manufactured by Nippon Pneumatic Manufacturing Co., Ltd.) where the classifying portion is replaced with a cyclone to remove the agglomerated inorganic fine particles.

A continuous printing test is conducted using a modified apparatus of a plain paper facsimile "TF-58HW" (manufactured by Toshiba Corporation) for the toner obtained as described above. As a result, excellent image quality is maintained with substantially no defects on the formed images up to copying of 15,000 sheets. Also, the photoconductor is taken out from the device to observe the surface thereof. As a result, substantially no damages are observed on the photoconductor.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A nonmagnetic one-component toner comprising a binder resin and a colorant, and inorganic fine particles having an average particle diameter of not less than 30 nm and less than 100 nm adhered on the toner surface, said binder resin being a polyester obtained by condensation polymerization between:

(a) a diol component represented by the following general formula ( I ):

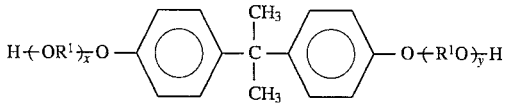

(I)

wherein $R^1$ represents an alkylene group having 2 to 4 carbon atoms, and x and y independently represent positive integers with an average sum of 2 to 16; and (b) an acid component containing:

(i) 1 to 50 mol % of a dicarboxylic acid represented by general formulas (II) or (III):

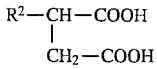

(II)

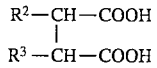

(III)

wherein $R^2$ and $R^3$, which may be identical or different, independently represent a saturated or unsaturated hydrocarbon group having 4 to 20 carbon atoms, or an anhydride thereof; and (ii) 10 to 30 mol % of trimellitic acid or an anhydride thereof.

2. The nonmagnetic one-component toner according to claim 1, wherein the average particle diameter of said inorganic fine particles is not less than 30 nm and not more than 70 nm.

3. The nonmagnetic one-component toner according to claim 1, wherein said inorganic fine particles are selected from the group consisting of silica, alumina, titania and zirconia.

4. The nonmagnetic one-component toner according to claim 1, wherein the amount of the inorganic fine particles added to the toner surface is 0.1 to 5% by weight.

5. The nonmagnetic one-component toner according to claim 1, wherein the polyester resin has a glass transition temperature of not less than 70° C.

6. A nonmagnetic one-component toner for use in a developer device having a developer roller and a blade, the blade serving to regulate a toner layer formed on the developer roller into a uniform thickness and to supply electric charges to the toner, the toner comprising a binder resin and a colorant, and inorganic fine particles having an average particle diameter of not less than 30 nm and less than 100 nm adhered on the toner surface, said binder resin being a polyester obtained by condensation polymerization between:

(a) a diol component represented by the following general formula (I):

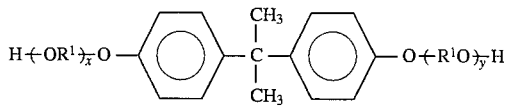

(I)

wherein $R^1$ represents an alkylene group having 2 to 4 carbon atoms, and x and y independently represent positive integers with an average sum of 2 to 16; and (b) an acid component containing:
(i) 1 to 50 mol % of a dicarboxylic acid represented by general formulas (II) or (III):
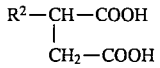
(II)
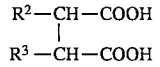
(III)
wherein $R^2$ and $R^3$, which may be identical or different, independently represent a saturated or unsaturated hydrocarbon group having 4 to 20 carbon atoms, or an anhydride thereof; and
(ii) 10 to 30 mol % of trimellitic acid or an anhydride thereof.
* * * * *